US008770503B2

(12) United States Patent
Weidman et al.

(10) Patent No.: US 8,770,503 B2
(45) Date of Patent: Jul. 8, 2014

(54) STAGED PAPER SHREDDER

(75) Inventors: Richard Weidman, Mississauga (CA); Gary Klowak, Burlington (CA); Douglas Bisson, Ancaster (CA); Ann Bisson, legal representative, Ancaster (CA)

(73) Assignee: Shred-It International ULC, Oakville, Ontario (CA)

( * ) Notice: Subject to any disclaimer, the term of this patent is extended or adjusted under 35 U.S.C. 154(b) by 353 days.

(21) Appl. No.: 13/012,202

(22) Filed: Jan. 24, 2011

(65) Prior Publication Data

US 2012/0006920 A1 Jan. 12, 2012

(30) Foreign Application Priority Data

Jul. 8, 2010 (CA) ..... 2709258

(51) Int. Cl.
*B02C 25/00* (2006.01)

(52) U.S. Cl.
USPC ..... 241/35; 241/36; 241/159; 241/236

(58) Field of Classification Search
USPC ..... 241/35, 36, 100, 236, 285.2, 296, 159, 241/33
See application file for complete search history.

(56) References Cited

U.S. PATENT DOCUMENTS

| | | | | | |
|---|---|---|---|---|---|
| 3,882,770 | A * | 5/1975 | Bleasdale | 100/49 |
| 3,921,920 | A * | 11/1975 | Brocard | 241/159 |
| 3,931,935 | A * | 1/1976 | Holman | 241/24.1 |
| 4,068,805 | A * | 1/1978 | Oswald | 241/159 |
| 4,101,083 | A * | 7/1978 | Faist | 241/285.1 |
| 4,529,134 | A * | 7/1985 | Williams | 241/30 |
| 4,884,756 | A * | 12/1989 | Pearson | 241/42 |
| 5,205,495 | A * | 4/1993 | Garnier | 241/31 |
| 5,312,052 | A * | 5/1994 | Dellekamp | 241/24.14 |
| 5,570,845 | A * | 11/1996 | Lewis et al. | 241/21 |
| 6,978,954 | B2 * | 12/2005 | Kroger et al. | 241/36 |
| 7,150,422 | B2 * | 12/2006 | Wang | 241/100 |
| RE40,126 | E * | 3/2008 | Rajewski | 241/223 |
| 2004/0104289 | A1 * | 6/2004 | Schwelling | 241/236 |
| 2012/0175443 | A1 * | 7/2012 | Neunzert | 241/30 |

FOREIGN PATENT DOCUMENTS

| | | | |
|---|---|---|---|
| EP | 411438 A1 * | 2/1991 | B02C 18/40 |
| EP | 1334771 | 8/2003 | |
| EP | 1454673 | 9/2004 | |

OTHER PUBLICATIONS

European Patent Office, Extended European Search Report for EP Patent App. No. 11275016.1, Nov. 18, 2011.

* cited by examiner

*Primary Examiner* — Shelley Self
*Assistant Examiner* — Leonel Vasquez
(74) *Attorney, Agent, or Firm* — Borden Ladner Gervais LLP; Neil Henderson

(57) ABSTRACT

This invention relates to a paper shredder. A first stage shredder accepts paper from a hopper. The first stage shredder includes two knife shaft assemblies with a plurality of sequentially oriented knives and spacers on hexagonal shafts. A second stage shredder accepts the output of the first stage shredder. The second stage shredder has two counter rotating shafts with saw tooth disk knives and separating spacers and cuts the paper finer than that of the first stage shredder. A third stage shredder may be connected to the second stage shredder providing even further paper size reduction.

2 Claims, 10 Drawing Sheets

STAGED PAPER SHREDDER

CROSS REFERENCE TO RELATED APPLICATIONS

This application claims the benefit of priority of Canadian Patent Application No. 2,709,258 filed Jul. 8, 2010, which is incorporated herein by reference in its entirety.

FIELD

The present application relates generally to the shredding of paper. More particularly, the present application relates to the shredding of paper to a very small size so as to make the shredded remnants unreadable.

BACKGROUND

The shredding of paper is well known but with the increased awareness and legal obligations to shred confidential documents to an unreadable and non re-constructible state, there is a void. In particular, although paper shredders can be designed to achieve the results in terms of size, they tend to have much slower throughput. Conventional apparatuses for shredding paper that deliver acceptable throughput rates produce shred sizing that generally are too large to be acceptable. Conventional systems utilize a screen surrounding the cutting blades to filter paper of a certain size, the larger pieces being shredded again, the smaller pieces passing to the next stage. Once appropriately sized, the smaller pieces pass through the screen. The disadvantage to this system is that staples, paper clips, or other metal may cause sparks within the screen and ignite the paper. In addition, screened apparatus generally have unacceptably low throughput. Thus there is a need for a shredder with increased throughput that produces fine shredding and reduces the possibility of fire during the shredding process.

SUMMARY

In an aspect herein, there is provided a paper shredder, the shredder including:

a hopper for receiving paper;

a first stage shredder comprising offset blades driven by a first stage power drive;

a second stage shredder operatively connected to the first stage shredder, the second stage shredder comprising offset blades driven by a second stage power drive; and a program logic controller adapted to control the paper shredder.

In a further aspect, the paper shredder further includes a third stage paper shredder operatively connected to the second stage shredder, the third stage shredder comprising offset blades driven by a third stage power drive; and a collection bin below said the third stage shredder.

In another aspect herein, there is provided a method for monitoring a multi-stage paper shredder the method executed by a programmable logic control to monitor motor speed for each stage and to shut down all preceding stages if a stage should jam.

In yet another aspect herein, there is provided a method for controlling a multi-stage paper shredder, the method executed by a programmable logic controller to monitor the amount of paper being fed to each stage, through the use of optical sensors, should too much paper arrive at any stage, shutting down said preceding stages until said too much paper is processed.

Other aspects and features of the present invention will become apparent to those ordinarily skilled in the art upon review of the following description of specific embodiments in conjunction with the accompanying figures.

BRIEF DESCRIPTION OF THE DRAWINGS

Embodiments will now be described, by way of example only, with reference to the attached Figures, wherein.

DETAILED DESCRIPTION

Figure 1:
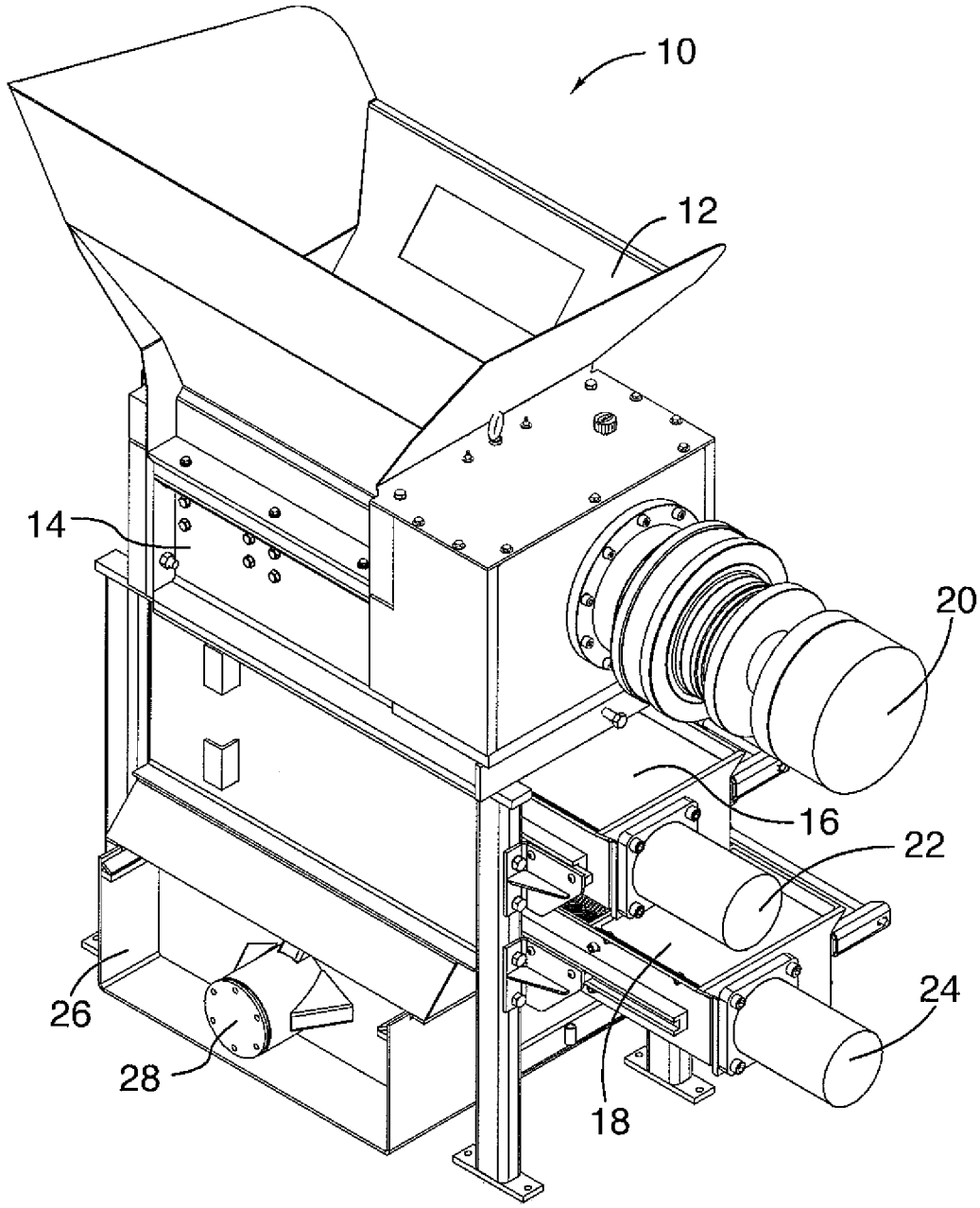
FIG. 1 is a perspective view of an embodiment of a paper shredder.

Referring first to FIG. 1, a perspective view of an embodiment of a paper shredder is shown generally as 10. A hopper 12 feeds paper into the shredder 10. The shredder 10 comprises three shredder stages being first stage shredder 14, secondary stage shredder 16 and third stage shredder 18. First stage power drive 20 provides power to first stage shredder 14. Second stage power drive 22 provides power to second stage shredder 16. Third stage power drive 24 provides power to third stage shredder 15. Each of power drives 20, 22 and 24 may provide power through the use of hydraulic or electric power. An example of a power drive 20 would be a hydraulic power drive, such as a planetary gear reducer provided by SAI Hydraulics, Inc. of Linwood Pa. Alternatively, Power drives 22 and 24 may not require planetary gears.

The first stage shredder 14 accepts paper from hopper 12. Paper may be introduced into hopper 12 by any number of means, for example by hand, by a tipper bin or by an infeed conveyor (not shown), such as a conveyor belt. Paper is cut by first stage shredder 14 and optionally by second stage shredder 16 and third stage shredder 18, depending upon how finely the paper is to be shredded. In the illustration of FIG. 1 third stage shredder 18 has been removed from contact with the paper shredded by second stage shredder 16.

Paper drops into collection bin 26 from which it can be removed. The paper arriving in collection bin 26 may also be compacted through the use of compactor 28. In addition, a discharge conveyor (not shown) may be utilized to remove paper from the collection bin 26.

Figure 2:
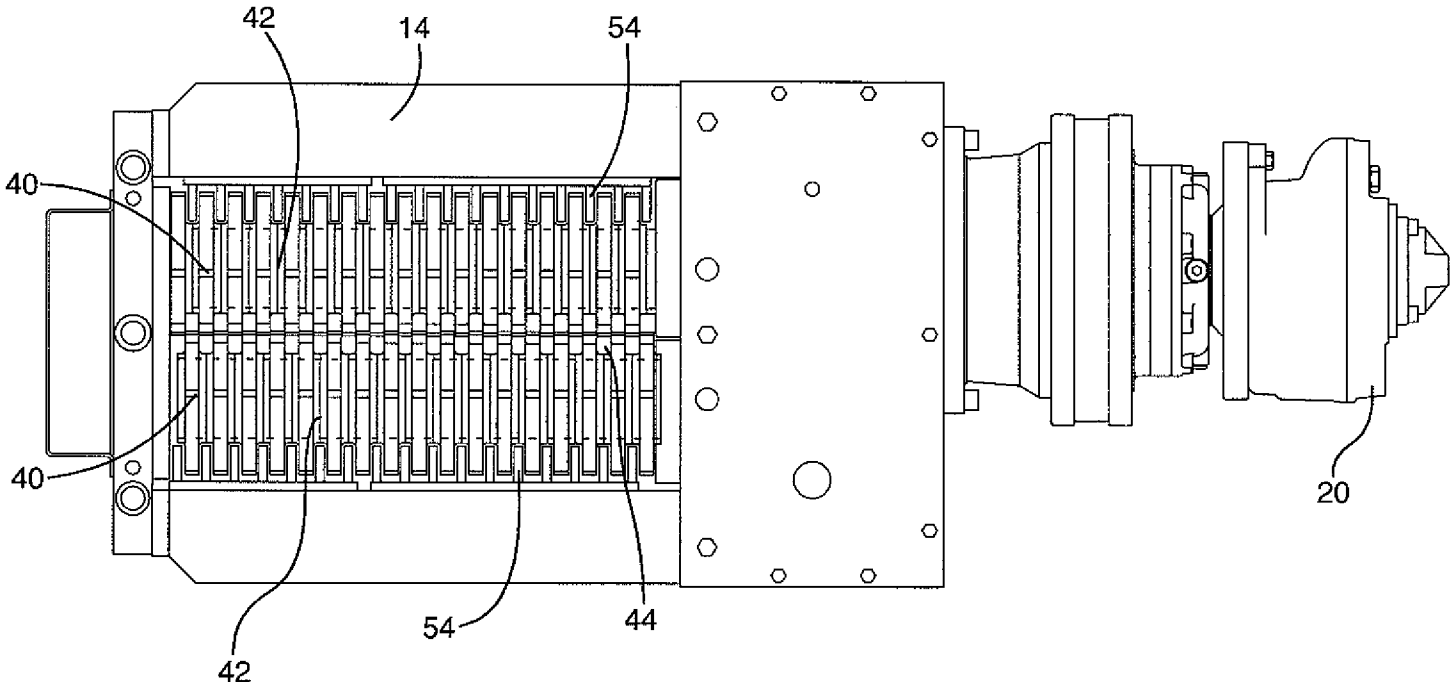
FIG. 2 is top view of a first stage shredder.

We now refer to FIG. 2, which shows a top view of first stage shredder 14. First stage power drive 20 turns drive shafts 40, which in turn drive multiple cutting knives 42 to shred the paper. Cutting knives 42 are separated by spacers 44. Cleaning blades 54 are mounted adjacent to cutting knives 42 to prevent the buildup of cut paper from jamming cutting knives 42.

Figure 3:
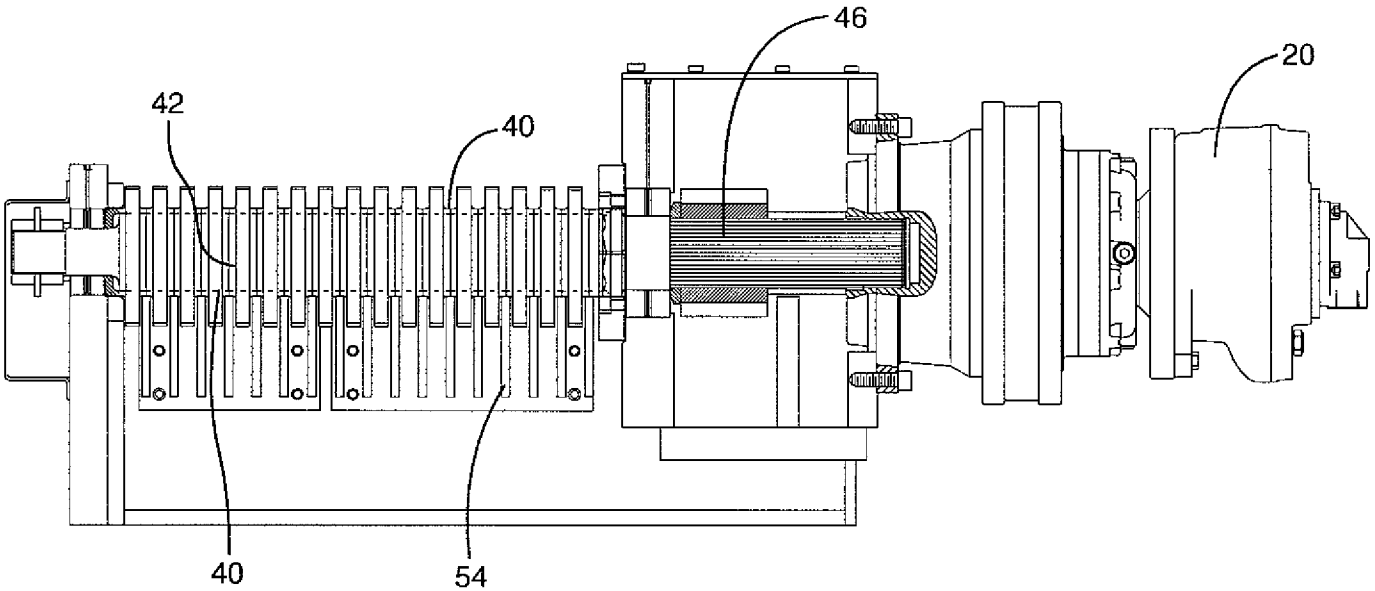
FIG. 3 is a side view of a first stage shredder.

FIG. 3 shows a side view of a first stage shredder. FIG. 3 illustrates the features of FIG. 2, namely: first stage power drive 20, drive shafts 40, cutting knives 42, spacers 44, and cleaning blades 54. In addition a main drive shaft 46 is shown.

Figure 4:
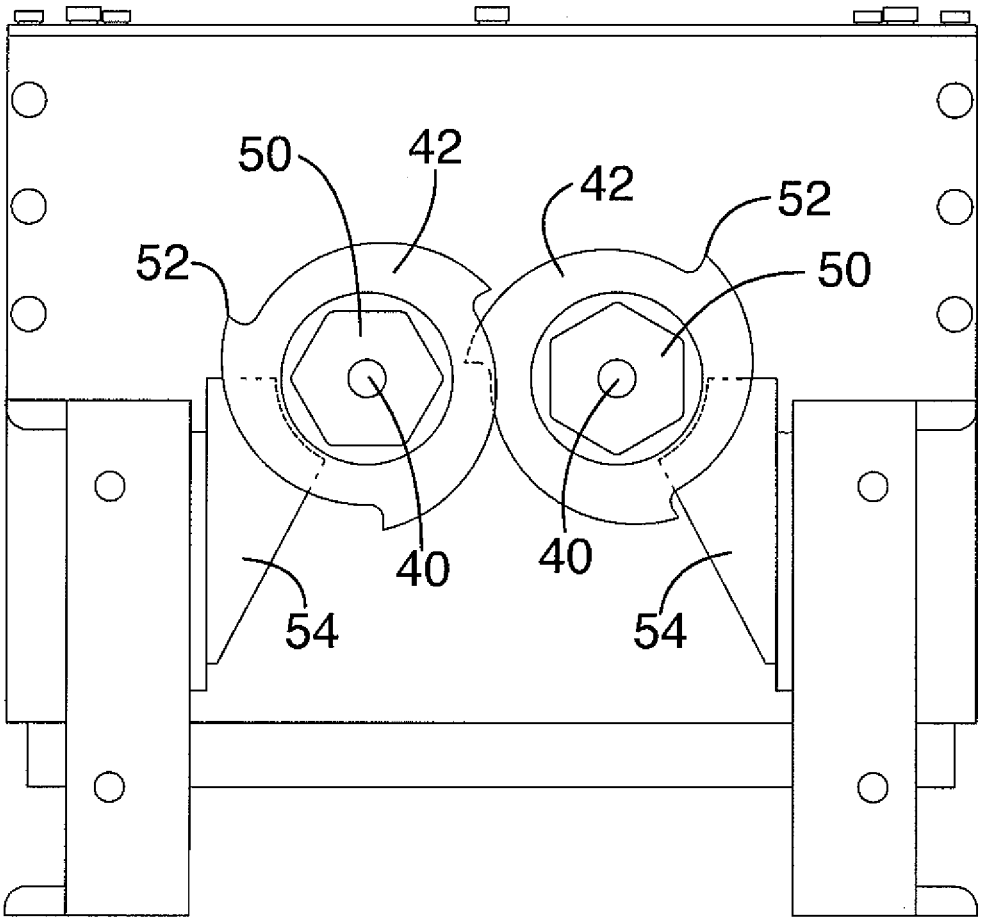
FIG. 4 is an end view of a first stage shredder.

Referring now to FIG. 4 an end view of a first stage shredder is shown. As shown in FIG. 4, each cutting knife 42 has three material capture hooks 52, but as one skilled in the art can appreciate, any number of material capture hooks 52 may be employed. In addition cleaning blades 54 are disposed between each cutting knife 42 to scrape away paper buildup between the cutting knives 42. Drive shafts 40 turn hexagonal shafts 50 which then turn cutting knives 42. In one embodiment hexagonal shafts 50 and cutting knives would be manufactured from a heat treated high alloy steel, such as American Iron and Steel Institute (AISI) standards 4140 and 4340. In one embodiment the drive shafts 40 would be on the order of three inches in diameter, the hexagonal shafts on the order of 5.8 inches between a centre line and the cutting knives 42 on the order of seven inches in diameter.

Figure 5:
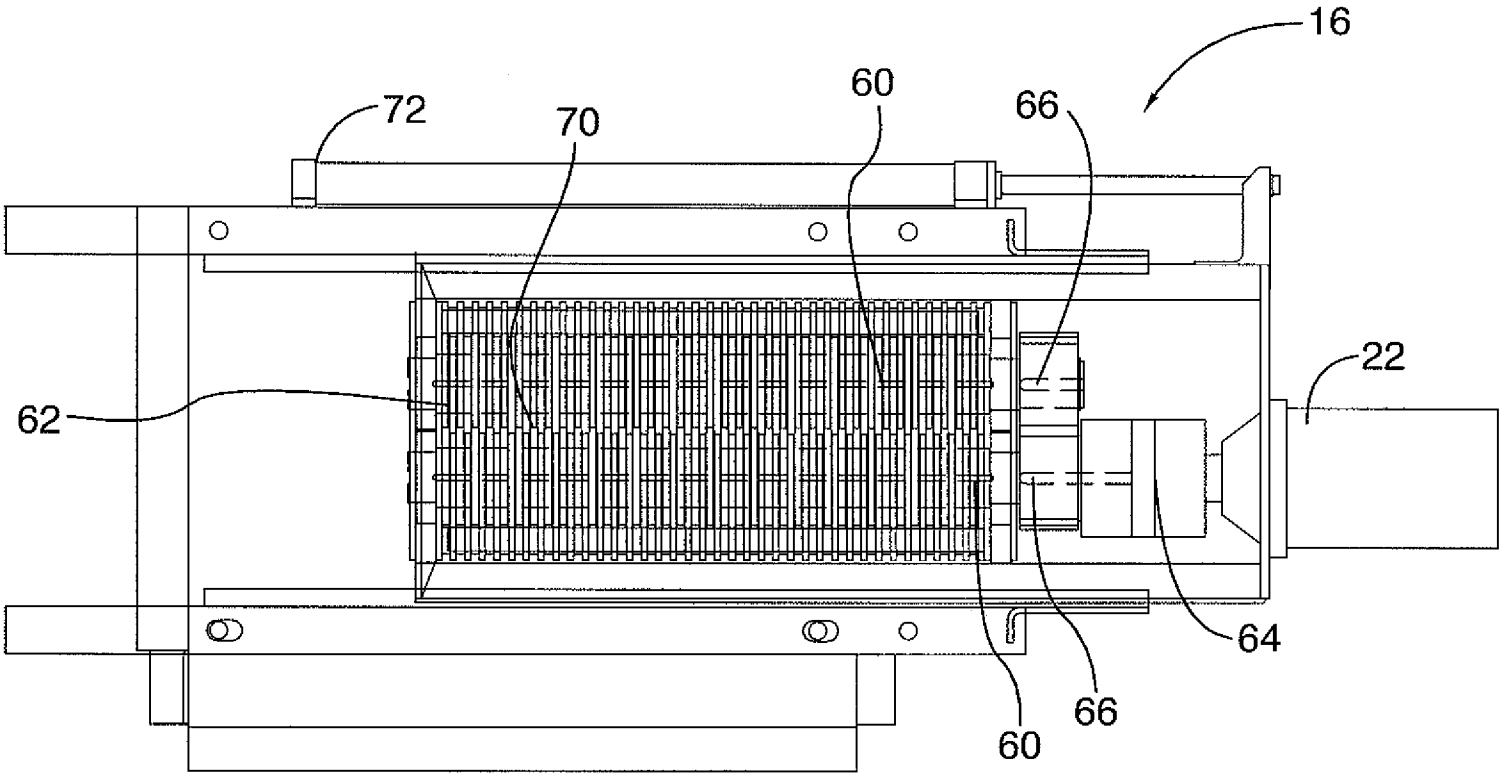
FIG. 5 is a top view of a second stage shredder.

Referring now to FIG. 5 a top view of a second stage shredder is shown. Second stage shredder 16 comprises a pair of horizontally disposed, parallel drive shafts 60. Drive shafts 60 are driven by second stage power drive 22 connected to a drive shaft 64 and spur gears 66. This configuration creates a counter rotating orientation that facilitates paper capture. The drive shafts 60 have a plurality of longitudinally spaced cutting disks 62 and spacers 70. Second stage shredder 16 is similar in construction to that of first stage shredder 14. One difference is that cutting disks 62 have a different construction than the cutting knives 42 of first stage shredder 14. The cutting disks 62 have a saw tooth hook profile to further reduce the sizing of the pre-shredded paper received by the second stage shredder 16. Second stage shredder 16 may be moved in and out of operating position through the use of hydraulic piston 72, allowing the operator to choose required shred size.

Figure 6:
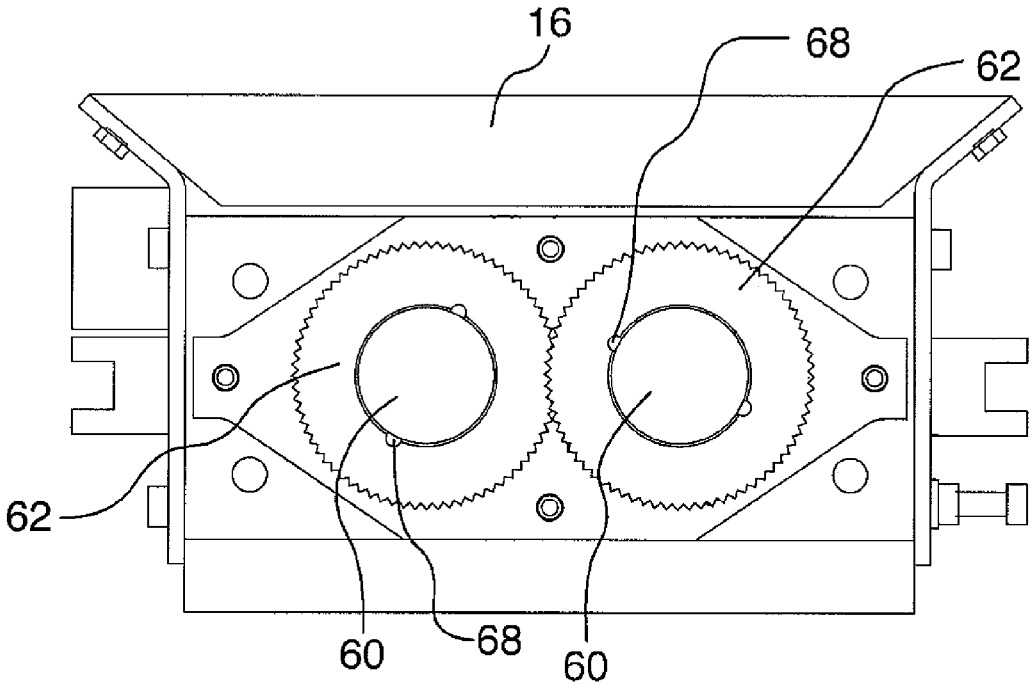
FIG. 6 is an end view of a second stage shredder.

Referring now to FIG. 6, an end view of a second stage shredder is shown. Cutting disks 62 are attached to parallel drive shafts 60 and secured to them by keyholes 68.

Figure 7:
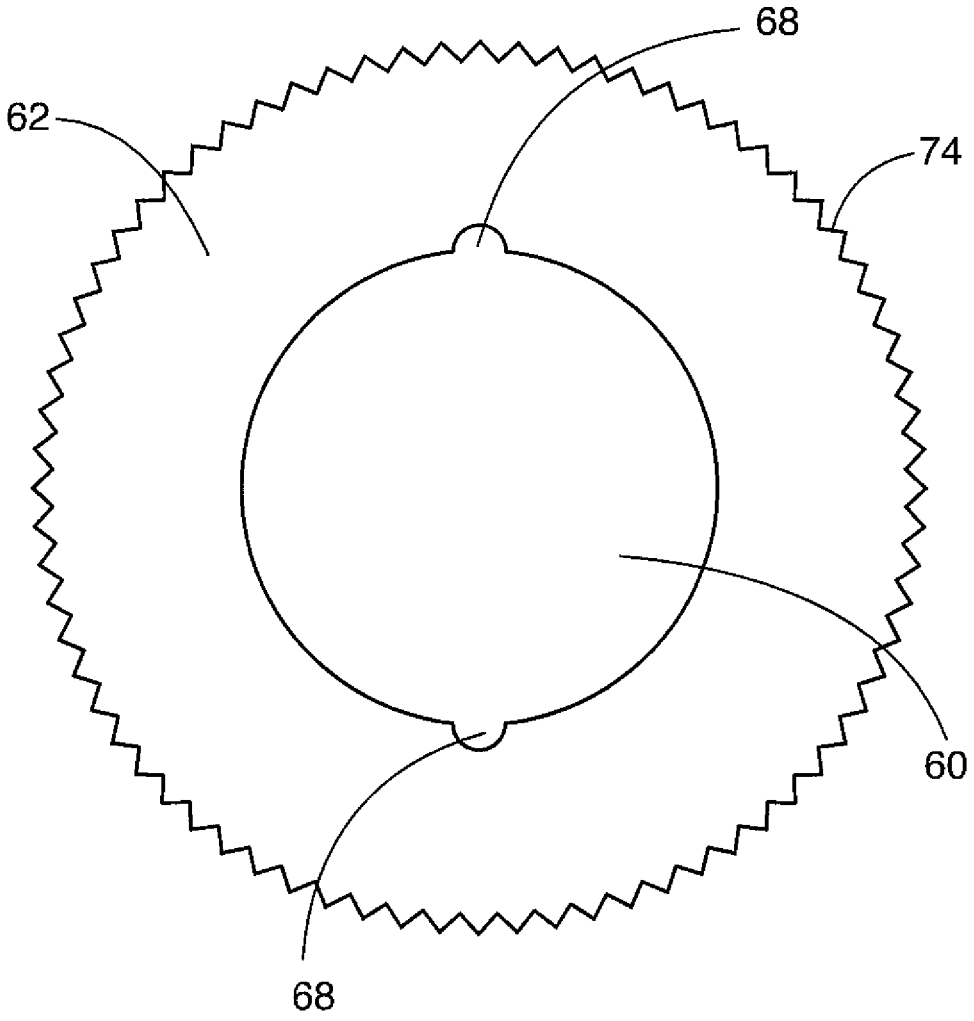
FIG. 7 is an end view of the cutting disks of the second stage and a third stage shredder.

Referring now to FIG. 7 an end view of the cutting disks of the second stage and third stage shredder are shown. The second stage and third stage shredder are identical in configuration save for the power supplied and the dimension of the cutting disks Each shredder stage has progressively smaller knives for shredding. By way of example, first stage shredder 14 would cut paper into strips approximately ⅝" in width. Second stage shredder 16 would cut paper into approximately ⅜" in width. Third stage shredder 18 would cut paper into approximately ¼". Thus each shredder in the system will have progressively narrower cutters to provide a finer shred. The cutting disks 62 have a saw tooth cutting edge 74 to further reduce the sizing of the pre-shredded paper presented to it.

In one example, parallel drive shafts 60 would have a diameter of on the order of two inches. Cutting disks 62 would have a diameter on the order of 4.5". In one embodiment it has been found that about 72 teeth, plus or minus, function well. A cutting disk 62 is connected to a parallel drive shaft 60 by keyholes 68.

Figure 8A:
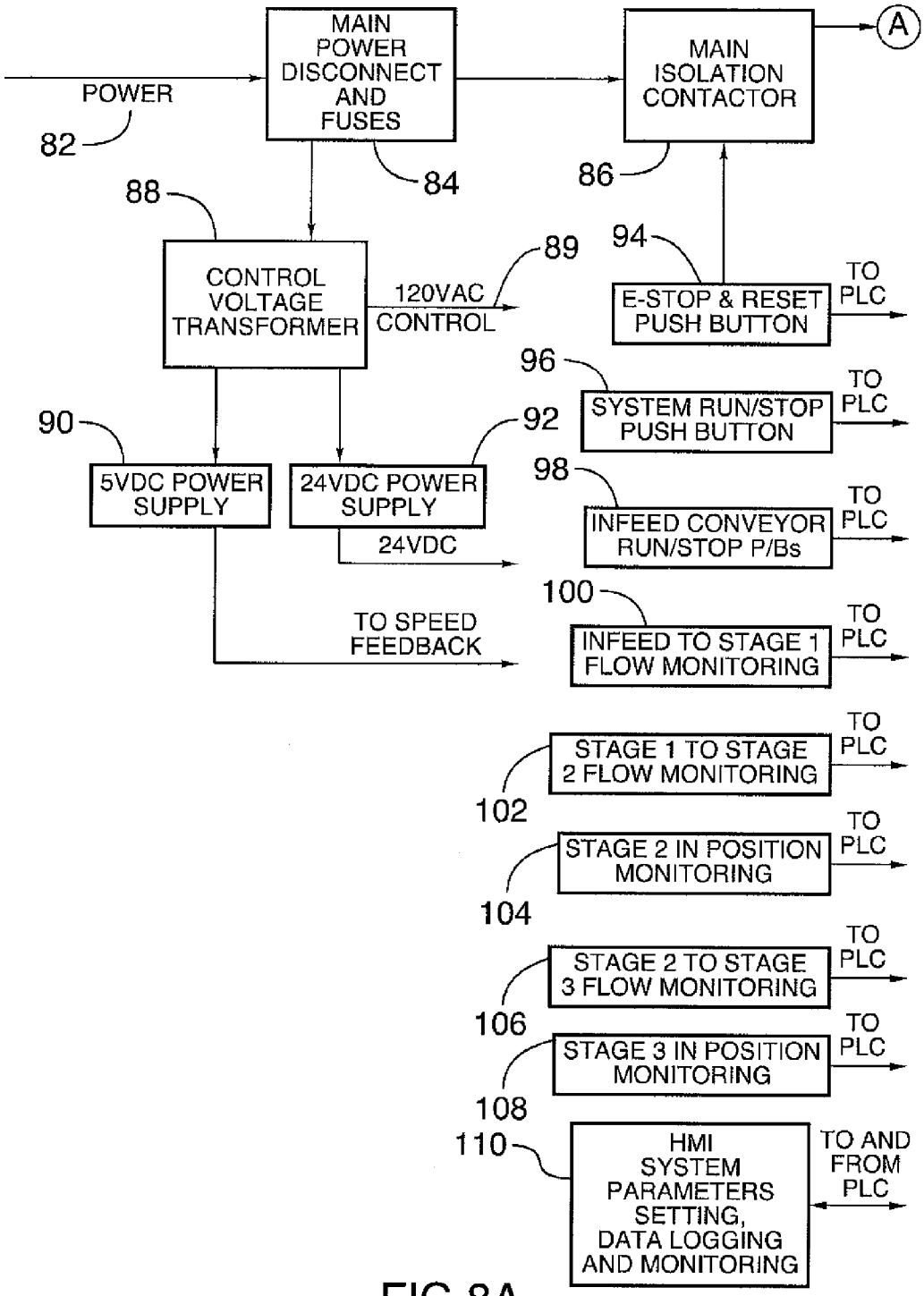
FIG. 8A and FIG. 8B are block diagrams of the components of a logic controller for a paper shredder.
Figure 8B:
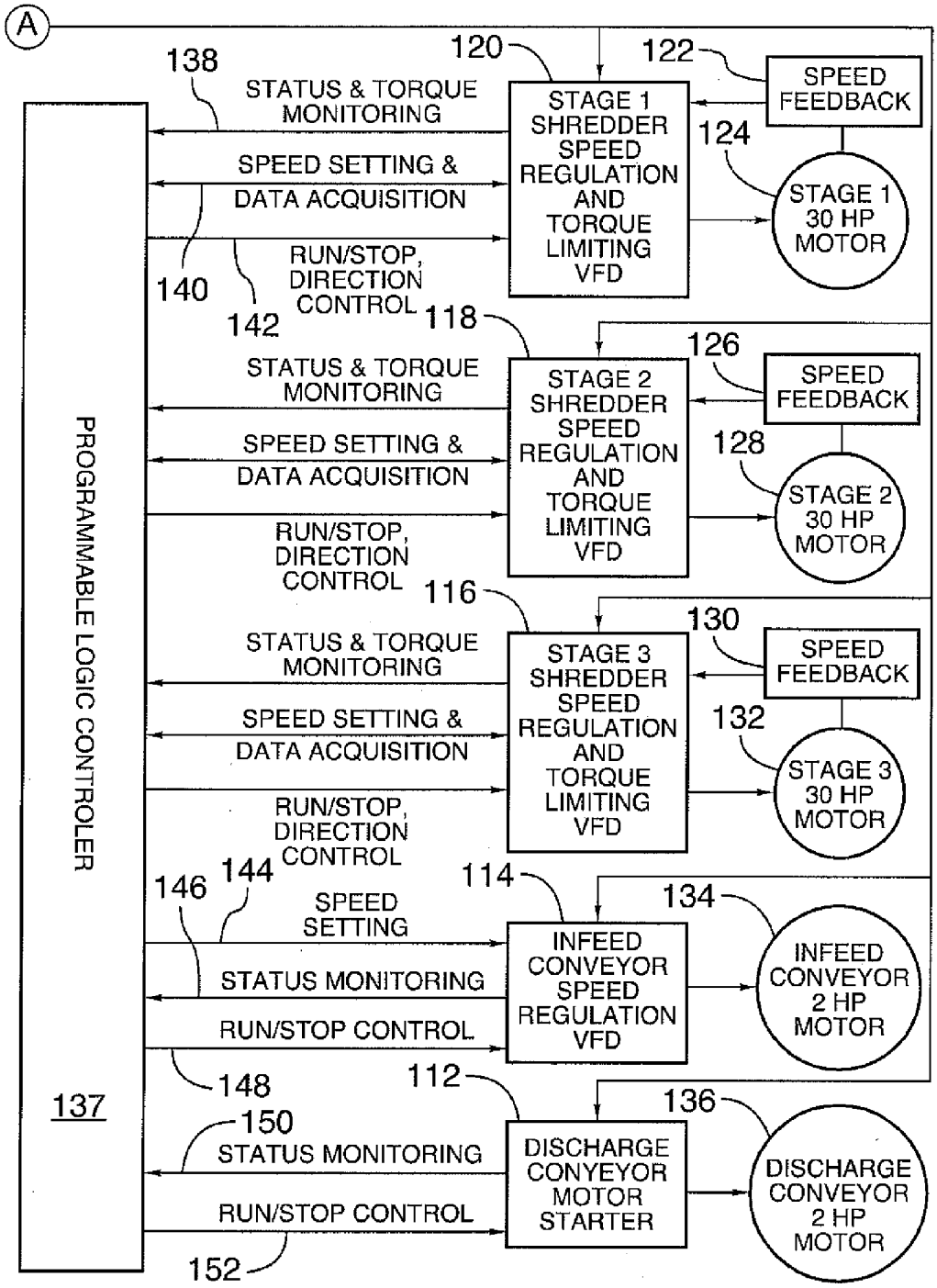

Referring now to FIG. 8A and FIG. 8B block diagrams of the components of a logic controller for a shredder are shown.

All shredders are controlled by Program Logic Controller (PLC 137). One such example being a Mitsubishi FX2N-32MR-ES. There are also included optical sensors between the first and second shredder and the second and third shredder to detect an over load of paper and stop the preceding shredders until the paper clears (see FIG. 9). The shredders are also interlocked to sense power load and shaft rotation. If the second or third shredder reverses due to overload the preceding shredders will immediately stop and wait for a forward signal before commencing shredding.

Power for the shredders is provided by feature 82. Examples would be 460 volts AC at 60 Hz., or 220 volts AC. Power 82 is directed to main power disconnect and fuses 84 which allows for the shutdown of the entire system. Main isolation contactor 86 is invoked if a fuse is blown and it shuts the system down. It is directly connected to features 112, 114, 116, 118 and 120 as shown in FIG. 8B. Note that an infeed conveyor (not shown) and a discharge conveyor (not shown) are optional element. Control voltage transformer 88 outputs a 120 volts AC control voltage signal 89 to power motors 124, 128, 132, 134 and 136.

Control voltage transformer 88 also provides power to 5 volt DC power supply 90 and 24 volt DC power supply 92. Feature 90 provides power to speed feedback encoders 122, 126 and 130. These encoders monitor the speed of their respective motors and provide feedback if a motor is running too slow, i.e. the shredder it drives may have become jammed. DC power supply 92 provides power to sensors for features 100, 102, 104, 106, 108 and 110.

Should the operator detect that too much paper is being fed into hopper 12, they may hit a push button (P/Bs) 98 to stop the system. In addition an optical sensor (see FIG. 9) may at step 100 detect that if too much paper is being provided to first stage shredder. If either of these occurs PLC 137 will be instructed to shut down the input to first stage shredder until the paper clears the optical sensors, upon which a start signal will be provided. An optical sensor at feature 102 detects if too much flow is going from first stage shredder 14 to second stage shredder 16. If this is the case, first stage shredder 14 is shut down until second stage shredder 18 can catch up.

A sensor at feature 104 indicates to PLC 137 that the second stage shredder 16 has been disengaged from the system, as it is not required for the shredding level needed. So it will not be receiving or transmitting any information while it is disengaged. In essence it is no longer part of the system.

Features 106 and 108 are identical in function to those of 102 and 104, save that they apply to third stage shredder 18.

Feature 94 is an emergency stop button that may be triggered by the operator which sends a signal to main isolation contactor 86 to shut down the system. Feature 96 is a system run/stop push button, which differs from feature 94 in that it is not an emergency stop button but rather a start or stop button.

Feature 110 is a Human Machine Interface (HMI) which allows the user to set the speed of the power drives 20, 22 and 24. HMI also collects data through the use of the various sensors to record data such as: running hours, average amp draw, alarm history, and number of reversals. In general the basic operating aspects of the system Features 116, 118 and 120 control the speed of power drives 20, 22 and 24. Drives 20, 22 and 24 are Variable Frequency Drives (VFD). As such their speed may be adjusted as required, or their direction reversed in the case of a jam. Each of features 116, 118 and 120 communicate with PLC 137. To avoid cluttering FIG. 8B, only one set of connections has been labeled, namely features 138, 140 and 142 connected to feature 120. These connections are identical to those of features 116 and 118. Connection 138 provides status and torque monitoring. Each drive 20, 22 and 24 provides the torque required to maintain a preset shaft speed. When torque climbs to a pre determined high point the shredder stage 14, 16 or 18 respectively will stop, reverse and start again. Connection 144 provides the current speed setting and receives changes for the same. Connection 146 also provides data acquisition such as speed settings and times of shutdowns. Connection 142 provides information on when to run or stop the shredder and in which direction it should run.

In the case of an optional infeed conveyor being installed, speed setting 144 informs feature 114 on the speed to be utilized. Status monitoring 146 provides to PLC 137 the current operating status of the infeed conveyor, for example stopped or running. Run/Stop control 148 instructs the infeed conveyor when to start and stop. In the case of an optional discharge conveyor, status monitoring 150 provides to PLC 137 the status of the discharge conveyor. For example is it running or is it shut down. Run/Stop control 152 instructs the discharge conveyor when to run or stop.

Figure 9:
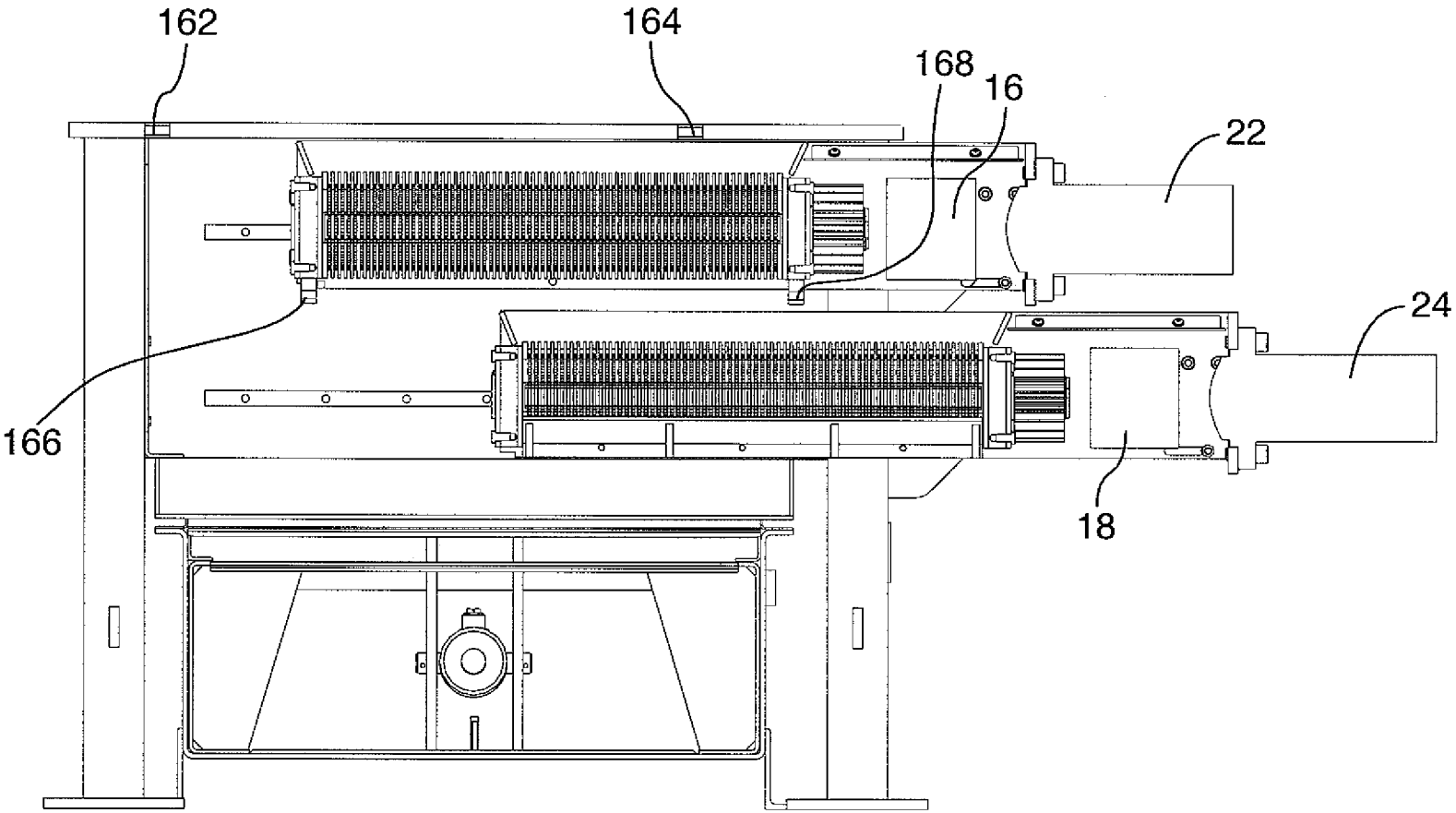
FIG. 9 is a view of a paper shredder indicating optical sensors.

Referring now to FIG. 9 a view of a shredder indicating optical sensors is shown. Examples of optical sensors would models LT100TB58J and LR100TB58J manufactured by Telco Sensors of Charlotte N.C., U.S.A. Should optical sensors 162 and 164 become blocked by paper being fed from the first stage shredder 14 into the second stage shredder 16, this indicates there is too much paper for second stage shredder 16 to handle. As a result first stage shredder 14 is shut down until second stage shredder 16 can catch up with the flow.

Should optical sensors 166 and 168 become blocked by paper being fed from the second stage shredder 16 into the third stage shredder 18, that indicates that there is too much paper for third stage shredder 18 to handle. As a result second stage shredder 16 and first stage shredder 14 are shut down until third stage shredder 18 can catch up with the flow.

Embodiments of the invention disclosed herein provide a compact, unitized, multistage shredding apparatus. Due to a small physical footprint and a relatively light weight. A shredder having all three stages has exterior dimensions of approximately 75"×45"×28" and weighs approximately. This in contrast to a single shaft screened shred with weighs approximately 5,500 pounds. This reduced size and weight allow embodiments of the shredder to be utilized in mobile installations in addition to stationary installations. The operator may selectively control the size of paper shredding at the push of a button, thus avoiding time consuming and labour intensive mechanical screen changes. This feature of selectively controlling the size of paper shredding can reduce the industry standard size of the shredded paper from ⅝"×2.5" to ⅛"×1".

The above-described embodiments of the invention are intended to be examples only. Alterations, modifications and variations can be effected to the particular embodiments by those of skill in the art without departing from the scope of the invention, which is defined solely by the claims appended hereto.

What is claimed is:

1. A paper shredder, said shredder comprising:

a hopper for receiving paper;

a first stage shredder comprising offset blades driven by a first stage power drive and first speed feedback components;

a second stage shredder operatively connected to said first stage shredder, said second stage shredder comprising offset blades driven by a second stage power drive and second speed feedback components;

a third stage shredder operatively connected to said second stage shredder, said third stage shredder comprising offset blades driven by a third stage power drive and third speed feedback components;

wherein the offset blades of the second stage shredder are smaller than the offset blades of the first stage shredder and larger than the offset blades of the third stage shredder; and a program logic controller adapted to control said paper shredder, wherein the program logic controller is configured to:

automatically detect if at least one of the first, second and third stage shredders is slowing based on the first, second and third speed feedback components and cause the detected stage shredder to operate in reverse for a predetermined time and then return to forward operation;

simultaneously stop any of the first or second stage shredders that precede the detected stage shredder while the detected stage shredder is reversing and then automatically start the stopped stage shredders once the detected shredder commences forward operation such that at least one of the first, second and third stage shredders remain in operation while at least one of the first, second and third stage shredders is stopped, and wherein the program logic controller is configured to hydraulically slidably remove at least one of said second or third stage shredders when at least one of said second or third stage shredders are not required based on user input.

2. The paper shredder of claim 1 wherein said program logic controller is operatively connected to optical sensors for each stage, said optical sensors informing said program logic controller if a stage is receiving an overload of paper so that the preceding stages may be shut down until the stage receiving the overload can deal with the flow, wherein once the overload is cleared the program logic controller restarts the preceding shredders.

* * * * *